United States Patent [19]

Okauchi et al.

[11] 4,430,424

[45] Feb. 7, 1984

[54] COLOR PHOTOGRAPHIC LIGHT-SENSITIVE MATERIAL

[75] Inventors: Ken Okauchi; Tatsuhiko Kobayashi, both of Hino, Japan

[73] Assignee: Konishiroku Photo Industry Co., Ltd., Tokyo, Japan

[21] Appl. No.: 413,687

[22] Filed: Sep. 1, 1982

[30] Foreign Application Priority Data

Sep. 4, 1981 [JP] Japan ..... 56-140037

[51] Int. Cl.[3] ..... G03C 1/76

[52] U.S. Cl. ..... 430/537; 430/543; 430/552; 430/554; 430/556; 430/566; 430/955

[58] Field of Search ..... 430/536, 566, 405, 961, 430/950, 543, 955, 537, 552, 554, 556

[56] References Cited

U.S. PATENT DOCUMENTS 3,342,599 9/1967 Reeves ..... 430/566
3,719,492 3/1973 Barr et al. ..... 430/376
3,775,160 11/1973 Clachan et al. ..... 430/536
4,288,531 9/1981 Adin et al. ..... 430/536
4,297,437 10/1981 Kaneko et al. ..... 430/566

*Primary Examiner*—J. Travis Brown
*Attorney, Agent, or Firm*—Jordan B. Bierman; Linda Bierman

[57] ABSTRACT

The invention relates to a color photographic light-sensitive material comprising a support and a hydrophilic colloid layer coated thereon, said layer comprising a non-diffusible coupler and a hydrophilic colloid layer having an aromatic primary amine developing agent and/or its precursor and a polymer layer coated thereon wherein said polymer is permeable to an alkaline processing liquid but less permeable to said aromatic primary amine developing agent and/or its precursor, and the diffusion rate of said aromatic primary amine developing agent and/or its precursor, when dissolved in the alkaline processing liquid, in the polymer layer is not greater than $5\times10^{-8}$ cm$^2$/sec per second at room temperature.

22 Claims, No Drawings

COLOR PHOTOGRAPHIC LIGHT-SENSITIVE MATERIAL

The present invention relates to a color photographic light-sensitive material, and more particularly to a silver halide color photographic light-sensitive material containing nondiffusible couplers and an aromatic primary amine developing agent and/or the precursor thereof.

It is known that in a color photographic light-sensitive material, the exposed silver halide particles thereof are developed by use of an aromatic primary amine developing agent, and the produced oxidized product of the aromatic primary amine developing agent then reacts with the couplers to form a dye image, whereby a color image is produced.

Normally, an aromatic primary amine developing agent is added to a color developer liquid. On the other hand, there has been known a method wherein an aromatic primary amine developing agent is incorporated into a light-sensitive material. Such a light-sensitive material basically enables the color development thereof in an alkaline aqueous solution, so that it facilitates the preparation of a developer therefor, simplifies the processing procedure, and permits to carry out a rapid processing. Further, that the BOD of the waste of the developer is small facilitates the disposal of the waste liquid. Thus, the developing agent-containing light-sensitive material has many advantages.

However, a color photographic light-sensitive material that contains an aromatic primary amine developing agent has such a problem that it is unable to give a satisfactorily color-developed density because the aromatic primary amine developing agent tends to run out into the processing liquid, so that the reaction between the developing agent and couplers cannot be sufficiently carried out. In order to obtain sufficient color densities, the incorporation of a large amount of the aromatic primary amine developing agent into the color photographic light-sensitive material may be conceivable, but this method brings about such undesirable effects that the light-sensitive material becomes deteriorated in the speed, fogged, or stained during the storage thereof.

Such developing agents for black-and-white film use as hydroquinone, catechol, and the like can be stably incorporated in the light-sensitive material, which incorporation is known to be made in the form of a metallic complex salt as is described in U.S. Pat. No. 3,295,978. In contrast, however, aromatic primary amine developing agents have large difficulty in the stable incorporation thereof. Many attempts have hitherto been made by a number of researchers to incorporate stably aromatic primary amine developing agents in the form of precursors thereof into color photographic light-sensitive materials.

For example, there have been known such methods as the use of the Schiff salt of an aromatic primary amine developing agent with salicylaldehyde as the precursor of the developing agent as described in U.S. Pat. No. 3,342,599; the use of the agent together with such a metallic salt as of lead, cadmium, or the like as described in U.S. Pat. No. 3,719,492; the use of the phthalimide type precursor obtained by the reaction of the agent with phthalic acid as described in British Pat. No. 1,069,061; the use of the agent together with a cyclic $\beta$-dicarbonyl compound as described in Japanese Patent Open to Public Inspection (hereinafter refered to as Japanese Patent O.P.I. Publication) No. 111729; the use of the precursor obtained by combining the agent with substituted or unsubstituted (2-benzene-sulfonyl)-ethoxycarbonyl as described in Japanese Patent O.P.I. Publication No. 135628/1978; the use of the precursor obtained by combining the agent with cyanoethyloxycarbonyl group as described in Japanese Patent O.P.I. Publication No. 79035/1979; and the like.

However, the above prior art alone is not enough to produce a sufficient color density in the development, and is still unable to prevent completely the deterioration of the sensitivity and the occurrence of fog or stain during the storage of the color photographic light-sensitive material.

In the case of the processing in succession of color photographic light-sensitive materials in an automatic processor, there has heretofore been used a method wherein the processing is made with replenishing the processing liquid according to the quantity of the color photographic light-sensitive materials to be processed, but the successive processing of color photographic light-sensitive materials that contain an aromatic primary amine developing agent and/or the precursor thereof requires the use of a fairly large amount of the replenisher.

The larger the amount of the aromatic primary amine developing agent and/or the precursor thereof running out of the color photographic light-sensitive material into the processing liquid the larger should the amount of the replenisher liquid be added, thus causing the amount of the liquid overflowing from the tank of the automatic processor to become larger, which becomes a serious problem from the standpoint of the antipollution measure as well as the economization.

It is a first object of the present invention to provide a color photographic light-sensitive material for which the processing procedure is simple and which is suitable for a rapid processing.

It is a second object of the present invention to provide a color photographic light-sensitive material that contains an aromatic primary amine developing agent and/or the precursor thereof which enables to produce sufficient color densities.

It is a third object of the present invention to provide a color photographic light-sensitive material which, although containing a small amount of an aromatic primary amine developing agent and/or the precursor thereof, is capable of producing sufficient color densities.

It is a fourth object of the present invention to provide a color photographic light-sensitive material that contains an aromatic primary amine developing agent and/or the precursor thereof which is significantly improved to prevent the deterioration of the sensitivity and the occurrence of fog or stain.

It is a fifth object of the present invention to provide a color photographic light-sensitive material that has an excellent stability in the successive processing by an automatic processor.

We, as the result of having devoted ourselves to studies to accomplish the above-mentioned objects, have found that the above objects can be attained by providing a polymer layer having the nature given below on top of a color photographic light-sensitive material containing an aromatic primary amine developing agent and/or the precursor thereof.

The aforementioned object of the present invention can be carried out in the manner that in a color photographic light-sensitive material comprising a support and thereon a hydrophilic colloidal layer comprising a nondiffusible coupler and a hydrophilic colloidal layer comprising an aromatic primary amine developing agent and/or a precursor thereof, said color photographic light-sensitive material further comprising a polymer layer at the furthest position from the support on the same side of said hydrophilic coloidal layer, which polymer layer is permeable to an alkaline processing liquid but less permeable to said aromatic primary amine developing agent and/or precursor thereof.

In the present invention, the color photographic light-sensitive material is of such a construction that during the processing of the light-sensitive material by an alkaline processing liquid, the processing liquid is supplied through the foregoing polymer layer to the foregoing hydrophilic colloidal layers. Therefore, the polymer layer enables the development of the color photographic light-sensitive material, so that it is an alkaline processing liquid-permeable layer. The polymer layer also is an aromatic primary amine developing agent-and/or-the precursor thereof-less-permeable layer. The nature of the polymer layer that it less permits the permeation of an aromatic primary amine developing agent and/or the precursor thereof means that when the color photographic light-sensitive material is in contact with an alkaline processing liquid, the aromatic primary amine developing agent and/or the precursor thereof hardly runs out into the alkaline processing liquid, and the diffusing rate constant of the aromatic primary amine developing agent and/or the precursor thereof dissolved into the alkaline processing liquid is preferably not more than $5\times10^{-8}$ cm$^2$/sec at room temperature.

We have found that when the polymer layer in which the above diffusing rate constant of not more than $5\times10^{-8}$ cm$^2$/sec is provided in the specified position of the color photographic light-sensitive material of the present invention, a satisfactory maximum density-having image can be obtained, whereas if the diffusing rate constant exceeds $5\times10^{-8}$ cm$^2$/sec, the aromatic primary amine developing agent and/or the precursor thereof incorporated in the color photographic light-sensitive material, during the processing in the alkaline processing liquid, becomes increasing in the amount to run out into the processing liquid, and thus any sufficient development is not carried out, resulting in the production of a low maximum density-having image.

A preferred example among polymers applicable to the foregoing polymer layer includes those copolymers having a unit represented by the formula:

$$(A)_x(B)_y(C)_z$$

Formula [I]

wherein A is a unit of a vinylidence chloride or a copolymerizable conjugated dience monomer; B is a unit of a copolymerizable ethylenycally unsaturated acid monomer or the salt thereof; C is a unit of copolymerizable ethylenically unsaturated monomer; x is from 50 to 99.5% by weight; y is from 0.5 to 10% by weight; and z is from 0 to 49.5% by weight.

Examples of copolymerizable conjugated diene monomers which may constitute unit A include 1,3-butadiene, alkyl(preferably lower alkyl having 1 to 4 carbon atoms)-substituted 1,3-butadiene(such as, e.g., isoprene, 1,3-pentadiene, 2-ethyl-1,3-butadiene, 2-n-propyl-1,3-butadiene, 2-n-butyl-1,3-butadiene, 2,3-dimethyl-1,3-butadiene, 2-methyl-1,3-pentadiene, 4-methyl-1,3-pentadiene, and the like); aryl (preferably phenyl)-substituted 1,3-butadiene (such as, e.g., 1-phenyl-1,3-butadiene, 2-phenyl-1,3-butadiene, 1-(p-chlorophenyl)-1,3-butadiene, 1-phenyl-2-carbomethoxy-1,3-butadiene, 2-p-tolyl-1,3-butadiene, and the like); halogen (preferably chlorine or bromine)-substituted 1,3-butadiene (such as, e.g., 1-chloro-1,3-butadiene, 2-chloro-1,3-butadiene, 1-bromo-1,3-butadiene, 2-bromo-1,3-butadiene, 1,1-dichloro-1,3-butadiene, 2,3-dichloro-1,3-butadiene, 2,3-dibromo-1,3-butadiene, 1,1,2-trichloro-1,3-butadiene, 1,1,2,3-tetrachloro-1,3-butadiene, and the like); and cyano-substituted 1,3-butadiene (such as, e.g., 1-cyano-1,3-butadiene, 2-cyano-1,3-butadiene, and the like).

Those preferred among these various conjugated dienes are 1,3-butadienes, alkyl (particularly methyl)- or halogen-substituted 1,3-butadienes, and those particularly preferred are 1,3-butadienes, isoprene, 2,3-dimethyl-1,3-butadiene, and further those most preferred are isoprene and 2,3-dimethyl-1,3-butadiene.

Copolymerizable ethylenically unsaturated acid monomers or monomers of the salt thereof which may constitute unit B include acrylic acid, methacrylic acid, itaconic aic, itaconic acid monoalkyl esters (preferably those esters containing an alkyl having from 1 to 4 carbon atoms such as, e.g., monomethyl itaconate, monobutyl itaconate, etc.), maleic acid monoesters (preferably those esters containing an alkyl having from 1 to 4 carbon atoms such as, e.g., monomethyl maleate, monobutyl maleate, etc.), and alkali metallic salts of these acids; and copolymerizable ethylenically unsaturated sulfonic acids include, e.g., styrene-sulfonic acid, acryloyloxyalkylsulfonic acids (such as, e.g., acryloyloxypropyl-sulfonic acid, acryloyloxyethyl-sulfonic acid), methacryloyloxyalkyl-sulfonic acids (such as, e.g., methacryloyloxypropyl-sulfonic acid, methacryloyloxybutyl-sulfonic acid), acrylamide-alkyl-sulfonic acids (such as, e.g., 2-acrylamide-2-methyl-ethane-sulfonic acid), methacrylamide-alkylsulfonic acids (such as, e.g., 2-methacrylamide-2-methyl-ethane-sulfonic acid), and alkali metallic salts of these acids.

Among these monomers suitable for constituting unit B, those preferred are acrylic acid, methacrylic acid, itaconic acid, and monomethyl esters, and the most preferred one is itaconic acid.

Copolymerizable ethylenically unsaturated monomers for constituting unit C include copolymerizable ethylenically unsaturated nitrils, styrenes, acrylic acid esters, methacrylic acid esters, acrylamides, methacrylamides, vinyl heterocyclic compounds, and cross-linkable monomers.

Copolymerizable ethylenically unsaturated nitriles include, e.g. acrylonitrile, methacrylonitrile, and $\alpha$-chloroacrylonitrile.

Styrenes include, e.g., styrenes, p-metyl styrene, $\alpha$-methyl styrene, p-chlorostyrene, and chloromethyl styrene.

Acrylic acid esters include, e.g., methyl acrylate, ethyl acrylate, n-butyl acrylate, n-propyl acrylate, isobutyl acrylate, secbutyl acrylate, 2-hydroxyethyl acrylate, and 2-hydroxypropyl acrylate.

Methacrylic acid esters include, e.g., methyl methacrylate, ethyl methacrylate, n-butyl methacrylate, 2-hydroxyethyl methacrylate, and 2-hydroxypropyl methacrylate.

Acrylamides include, e.g., acrylamide, diacetone acrylamide, methylol acrylamide, and methyl acrylamide.

Methacrylamides include, e.g., methacrylamide, benzyl methacrylamide.

Vinyl heterocyclic compounds include, e.g., N-vinyl pyrolidone, N-vinyl imidazole, vinyl pyridines (such as, e.g., 4-vinyl pyridine, 2-vinyl pyridine, etc.).

Cross-linkable monomers include, e.g., divinyl benzene, ethylene glycodimethacrylate, trimethylol-propane triacrylate, and pentaerythritol trimethacrylate.

Among these monomers suitable for constituting unit C those preferred are copolymerizable ethylenically unsaturated nitriles (particularly acrylonitrile and methacrylonitrile), styrenes (particularly styrene), acrylic acid esters (particularly those esters containing a lower alkyl having from 1 to 4 carbon atoms, such as methyl acrylate, 2-hydroxyethyl acrylate, n-butyl acrylate), and methacrylic acid esters (particularly those esters containing a lower alkyl having from 1 to 4 carbon atoms, such as methyl methacrylate), and the most preferred one is methyl acrylate.

The X, the percent by weight of unit A in the polymer, is from 50 to 99.5, and preferably from 50 to 80.

The y, the percent by weight of unit B, is from 0.5 to 10, and preferably from 0.5 to 8.

The z, the percent by weight of unit C, is from 0 to 49.5, and preferably from 15 to 45.

In the above polymer, monomers to constitute each of unit A, B and C may be in combination of not less than 2 kinds thereof.

The following are examples of those polymers applicable to composing the essential polymer layer of the present invention, but the present invention is not limited thereto:

Exemplified compounds

A-1 1,3-butadiene—styrene—itaconic acid copolymer (preparation ratio by weight: 70:25:5)

A-2 1,3-butadiene—methylacrylate—acrylic acid copolymer (preparation ratio by weight: 60:37:3)

A-3 1,3-butadiene—acrylonitrile—methacrylic acid copolymer (preparation ratio by weight: 65:33:2)

A-4 1,3-butadiene—methyl methacrylate—2-methacrylamide-2-methyl-ethane-sulfonic acid copolymer (preparation ratio by weight: 60:30:10)

A-5 1,3-butadiene—acrylic acid-n-butyl-maleic acid monomethyl copolymer (preparation ratio by weight: 55:40:5)

A-6 Isoprene—acrylonitrile—acrylic acid copolymer (preparation ratio by weight: 60:38:2)

A-7 Isoprene—methacrylonitrile—methacrylic acid copolymer (preparation ratio by weight: 65:32:3)

A-8 Isoprene—butadiene—styrene—acrylic acid copolymer (preparation ratio by weight: 50:30:15:5)

A-9 Isoprene—1,3-dimethyl-butadiene—acrylonitrile—acrylic acid copolymer (preparation ratio by weight: 40:30:25:5)

A-10 Isoprene—acrylonitrile—divinyl benzene—acrylic acid copolymer (preparation ratio by weight: 60:37:0.5:2.5)

A-11 Isoprene—acrylonitrile—N-vinyl pyrolidone—acrylic acid copolymer (preparation ratio by weight: 75:20:3:2)

A-12 Isoprene—methyl acrylate—methacrylic acid copolymer (preparation ratio by weight: 65:31:4)

A-13 2,3-dimethyl-1,3-butadiene—acrylonitrile—acrylic acid copolymer (preparation ratio by weight: 70:25:5)

A-14 2,3-dimethyl-1,3-butadiene—acrylonitrile—acrylic acid copolymer (preparation ratio by weight: 75:19:6)

A-15 2,3-dimethyl-1,3-butadiene—methyl methacrylate—acrylic acid copolymer (preparation ratio by weight: 75:19:6)

A-16 Chloroprene—p-methyl styrene—itaconic acid copolymer (preparation ratio by weight: 65:27:8)

A-17 Chloroprene—n-butyl acrylate—2-hydroxyethyl methacrylate—methacrylic acid copolymer (preparation ratio by weight: 75:15:5:5)

A-18 Chloroprene—acrylonitrile—acrylic acid copolymer (preparation ratio by weight: 65:30:5)

A-19 2-bromo-1,3-butadiene—styrene—itaconic acid copolymer (preparation ratio by weight: 75:17:8)

A-20 2-bromo-1,3-butadiene—acrylonitrile—acrylic acid copolymer (preparation ratio by weight: 60:32:8)

A-21 2-bromo-1,3-butadiene—n-butyl acrylate—monomethyl maleate copolymer (preparation ratio by weight: 65:32:3)

A-22 2,3-dimethyl-1,3-butadiene—isoprene—acrylonitrile—acrylic acid copolymer (preparation ratio by weight: 30:30:36:4)

A-23, 1,3-butadiene—n-butyl acrylate—acrylic acid copolymer (preparation ratio by weight: 80:15:5)

A-24 Vinylidene chloride—methyl acrylate—itaconic acid copolymer (preparation ratio by weight: 55:39:6)

A-25 Vinylidene chloride—methyl acrylate—acrylic acid copolymer (preparation ratio by weight: 60:37:3)

A-26 Vinylidene chloride—acrylonitrile—methacrylic acid copolymer (preparation ratio by weight: 65:33:2)

A-27 Vinylidene chloride—methyl methacrylate—2-methacrylamide-2-methyl-ethane-sulfonic acid copolymer (preparation ratio by weight: 60:30:10)

A-28 Vinylidene chloride—n-butyl acrylate—monoethyl maleate copolymer (preparation ratio by weight: 55:40:5)

A-29 Vinylidene chloride—p-methyl styrene—itaconic acid copolymer (preparation ratio by weight: 65:27:8)

A-30 Vinilidene chloride—acrylonitrile—acrylic acid copolymer (preparation ratio by weight: 60:36:4)

A-31 Vinylidene chloride—styrene—itaconic acid copolymer (preparation ratio by weight: 70:25:5)

The above-enumerated exemplified compounds may be produced by a polymerization method selected according to purposes and the characteristics of monomers to be used from normally used polymerization methods such as the solution polymerization method, emulsion polymerization method, suspension polymerization method, and the like.

The produced polymer may be used either in the form of an aqueous-dispersible polymer such as latex according to purposes or in the form of a solution prepared by dissolving in an appropriate solvent the precipitate thereof after being refined.

The preferred molecular weight of a polymer to be used in the present invention cannot be simply determined because it depends on the composition and the like of the polymer, but where the polymer, as described in above, is used in the form of an aqueous-dispersible polymer, the molecular weight thereof is desirable to be in the range of from tens of thousands to hundreds of thousands, while where it is dissolved in a solvent to be coated as the polymer layer, the molecular weight is desirable to be in the range of from thousands to tens of thousands.

The particularly preferred polymer layer of the present invention may be obtained by coating a coating liquid prepared in the manner that a polymer latex produced by the emulsion polymerization method is precipitated by use of a water-miscible solvent (e.g., methanol) and dried, and then dissolved into a solvent (such as, e.g., methyl-ethyl ketone, aceton, ethyl acetate, etc.).

The polymer latex may be produced by stirring at a rate of from 150 to 300 r.p.m. for a period of from 5 to 8 hours in a nitrogen gas-replaced reactor, maintaining at a temperature of from 30° to 60° C. a mixture of, e.g., deaerated water, surfactant (e.g., TRAX H-45, manufactured by Nippon Oils & Fats Co., Ltd.), each monomer, polymerization initiator (such as potassium persulfate or the like), and sodium metabisulfite.

The following is an example of the synthesis of a polymer for use in the present invention, but the present invention is not limited thereto.

SYNTHESIS EXAMPLE (Synthesis of Exemplified Compound A-24)

200 ml of deaerated water, 40 ml of TRAX H-45 (surfactant, the product manufactured by Nippon Oils & Fats Co., Ltd., available component: 30%), 330 g of vinylidene chloride, 234 g of methyl acrylate, 36 g of itaconic acid, 0.5 g of potassium persulfate, and 0.35 g of sodium metabisulfite were put in a 500-ml glass autoclave, which, after being closed up tight, was cooled by dry ice with acetone to solidify the contents thereof. After that, the air inside the autoclave was removed by means of a vacuum pump to replace it with nitrogen gas, thus repeating the procedure several times to completely fill up the autoclave with nitrogen gas, and further to increase the pressure of the nitrogen gas thereinside up to 5 kg/cm$^3$.

The autoclave was gradually heated to fuse the contents thereinside, and further heated, with keeping the stirring at the rate of 300 r.p.m., so that the inside temperature rises up to 95° C., and under the conditions of the same temperature and the same stirring rate, the reaction took place over a period of 6 hours.

After completion of the reaction, the inside temperature was cooled to room temperature, and the reaction product was then taken out.

The reaction product was filtrated, the residuum was removed, and the degree of the polymerization was examined. The result showed 98.7%.

The thus produced polymer latex may be used, as it is, as the polymer layer of the present invention, and also may, after precipitation, drying, and coating with the use of a solvent, be used as the polymer layer.

The thickness of the polymer layer of the present invention is acceptable if it is within such the range as to retain the nature that it, as the aforementioned nature of the polymer layer, well permits the permeation of an alkaline processing liquid but less permits the permeation of an aromatic primary amine developing agent and/or the precursor thereof, and it depends upon the kind of the polymer used to compose the polymer layer. The preferred thickness of the polymer layer is from 0.3 to 5$\mu$, and more preferably from 0.5 to 2$\mu$.

The amount of the aromatic primary amine developing agent and/or the precursor thereof to be incorporated into the color photographic light-sensitive material of the present invention is within the range of from 0.01 to 4.0 times mole per unit area to the whole quantity of the silver of the color photographic light-sensitive material, and preferably from 0.05 to 2.0 times mol.

The hydrophilic colloidal layer containing the aromatic primary amine developing agent and/or the precursor thereof is allowed to be either provided separately from or the same as the nondiffusible coupler-containing hydrophilic colloidal layer, but is desirable to be provided separately in such a way that nondiffusible couplers are in the silver halide emulsion layers, while the aromatic primary amine developing agent and/or the precursor thereof is in the interlayers.

Preferred examples of the aromatic primary amine developing agent for use in the present invention are those having the formula:

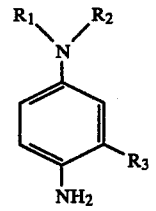

wherein $R_1$, $R_2$ and $R_3$ each is hydrogen or a substituted or unsubstituted alkyl having from 1 to 4 carbon atoms.

The precursor of the aromatic primary amine developing agent applicable to the present invention include such compounds as will be enumerated hereinafter: for example, those Schiff bases of aromatic primary amine developing agents with salicylaldehyde as described in U.S. Pat. No. 3,342,599; those addition products of aromatic primary amines with such metals as lead, cadmium, etc. as described in U.S. Pat. No. 3,719,492; those precursors of the phthal imide type obtained by the reaction between aromatic primary amines and phthalic acid as described in British Pat. No. 1,069,061; those precursors obtained by the combination of aromatic primary amines with $\beta$-(benzene-sulfonyl)-ethoxy carbonyl as described in Japanese Patent O.P.I. Publication No. 135628/1978; those precursors obtained by the combination of aromatic primary amines with $\beta$-cyanoethoxy carbonyl as described in Japanese Patent O.P.I. Publication No. 79035/1979; and those precursors obtained by the addition of tetraphenyl boron to aromatic primary amines as described in Japanese Patent O.P.I. Publication No. 82175/1979.

Examples of the precursor of the aromatic primary amine developing agent which best meet the object of the present invention are enumerated above, but the present invention is not limited thereto:

| No. | Formula |
|---|---|
| B-1 | 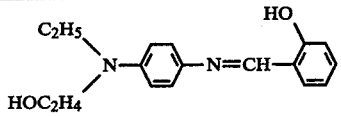 |
| B-2 | 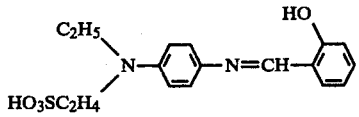 |
| B-3 | 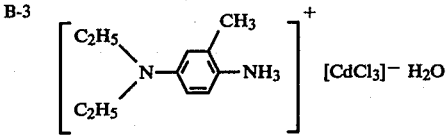 |

-continued
| No. | Formula |
|---|---|
| B-4 | 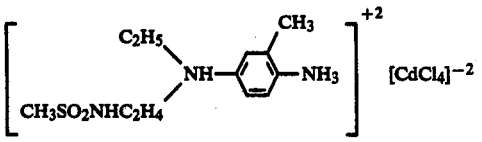 |
| B-5 | 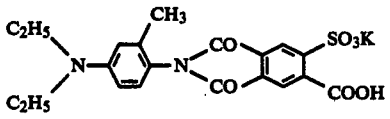 |
| B-6 | 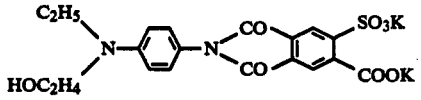 |
| B-7 | 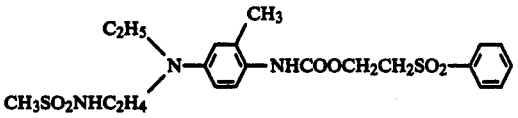 |
| B-8 | 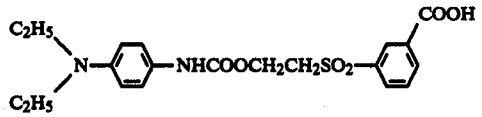 |
| B-9 | 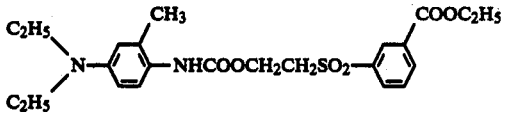 |
| B-10 | 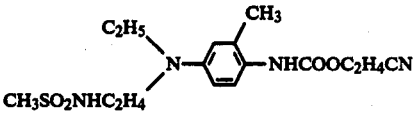 |
| B-11 | 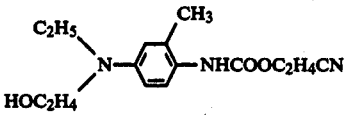 |
| B-12 | 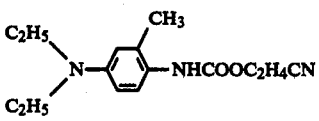 |
| B-13 | 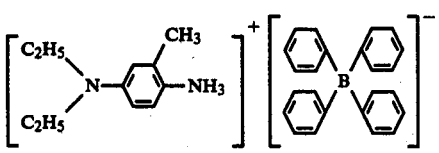 |
| B-14 | 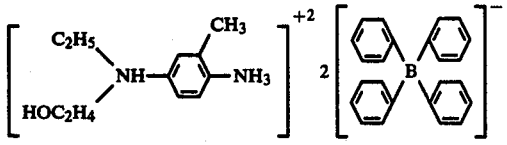 |
| B-15 | 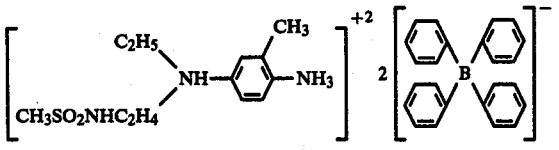 |
| B-16 | 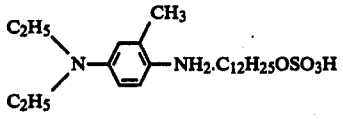 |
| B-17 | 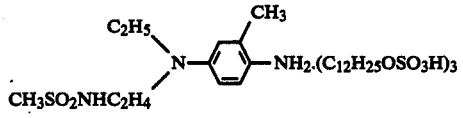 |
| B-18 | 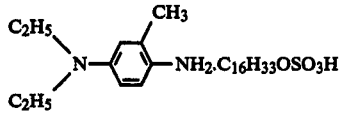 |
| B-19 | 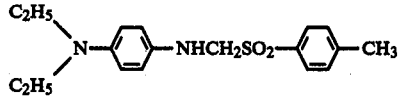 |
| B-20 | 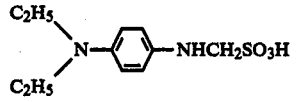 |
| B-21 | 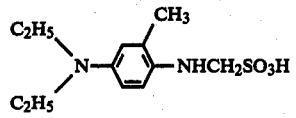 |
| B-22 | 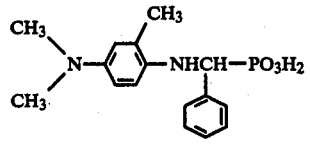 |
| B-23 | 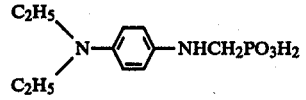 |
| B-24 | 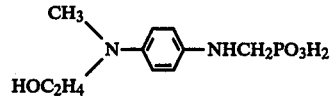 |
| B-25 | 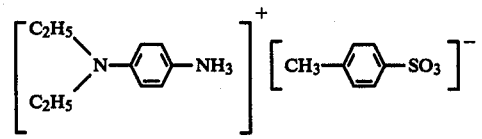 |
The aromatic primary amine developing agent and/or the precursor thereof for use in the present invention may, after being dissolved into a hydrophilic organic solvent (such as methyl alcohol, ethyl alcohol, acetone, etc.), be dispersed, as it is, into a hydrophilic colloidal solution or may be dispersed into a hydrophilic colloidal solution by a method wherein latex or an equivalent polymer is used or by the oil/water emulsification type dispersion method. The oil for use in the oil/water emulsification type dispersion method includes those coupler-dissolving oils to be used for the oil-protection type light-sensitive material, such as, for example, tri-o-cresyl phosphate, trihexyl phosphate, dioctyl-butyl phosphate, dibutyl phthalate, diethyllaurylamide, 2,4-diallyl-phenol, octyl benzoate, and the like.

In order to disperse the oil phase into which these are dissolved into an aqueous phase, a normal surfactant is used: for example, an anionic surfactant containing such an acid radial as of, e.g., carboxylic acid, sulfonic acid, phosphoric acid, a sulfuric acid ester, a phosphoric acid ester or the like, nonionic, cationic, or amphoteric surfactant is used.

For the hydrophilic colloidal layer, in addition to gelatin, those known as the binder material for photographic use may be used: There may be used a large variety of synthetic hydrophilic macromolecular materials such as homo- or co-polymers including, for example, gelatin derivatives, craft polymers of gelatin with other macromolecular materials, cellulose derivatives such as hydroxyethyl cellulose, carboxymethyl cellulose, cellulose sulfuric esters, sodium alginate, starch derivatives, polyvinyl alcohol partial acetal, poly-N-vinyl pyrolidone, polyacrylic acid, polymethacrylic acid, polyacrylamide, polyvinylimidazole, polyvinyl pyrazole, and the like. In addition to the above, latex or the like may be added, such as, e.g., those compounds as described in U.S. Pat. No. 3,518,088 and Research Disclosure Augusi, 1976, No. 148–14850.

And to the emulsified material, a known photographic oxidation inhibitor or stabilizer may be added: For example, reductones such as hydroquinone derivatives, ascorbic acid, or the like, hydroxyl amines, sulfonyl compounds, active methylene compounds, or the like may be added.

As compared to the conventional color processing, the processing to be used in the present invention differs only in that the color developing bath is basically a developing agent-free alkaline processing bath, and except this, other conventional processing baths can be applied, as they are, to the present invention.

The pH of the the alkaline processing liquid is within the range of from about 7 to about 14, and preferably from about 8 to about 13. The processing temperature of the alkaline liquid may be selected from the range of from 20° C. to 70° C., but preferably from 25° C. to 55° C.

As the buffer for use in the alkaline processing liquid, sodium hydroxide, potassium hydroxide, sodium carbonate, potassium carbonate, sodium tertiary phosphate, potassium tertiary phosphate, potassium metaborate, borax, or the like may be used singly or in combination. And for the purpose of increasing the buffering ability, for the convenience of preparation, or for increasing the ionic strength, there may be further used such various salts as disodium or dipotassium monohydric phosphate, sodium or potassium dihydric phosphate, sodium or potassium hydrogencarbonate, boric acid, alkali nitrates, alkali sulfates, or the like.

An appropriate amount of an antifoggant may also be incorporated, which includes inorganic halide compounds and known organic antifoggants. Typical examples of such inorganic halide compounds include such bromides as sodium bromide, potassium bromide, ammonium bromide, and the like, and such iodides as potassium iodide, sodium iodide, and the like. On the other hand, examples of such organic antifoggants include 6-nitrobenzimidazole as described in U.S. Pat. No. 2,496,940; 5-nitrobenzimidazole as described in U.S. Pat. Nos. 2,497,917 and 2,656,271; diaminophenazine, o-phenylenediamine, mercaptobenzimidazole, methylbenzimidazole, mercaptobenzoxazole, thiouracil, and 5-methyl-benztriazole as described in the Journal of the Society of Photographic Science and Technology of Japan, vol. 11, p.48 ( B 1948); and those heterocyclic compounds typified by the compounds as described in Japanese Patent Examined Publication No. 41675/1971. In addition, as antifoggants other than these compounds, those described in the KAGAKU SHASHIN BINRAN (Handbook of Photographic Science and Technology) vol. 2, p. 119 (1959), published by Maruzen Co., Ltd., may also be used. For surface development control, there may be used such known development inhibitors as described in Japanese Patent Examined Publication Nos. 19039/1971 and 6149/1970, and U.S. Pat. No. 3,295,976, and the like.

Besides the above, ammonium chloride, potassium chloride, sodium chloride, or the like may, if necessary, be added. Further, if necessary, an arbitrary development accelerator may be added together, which may be typified by pyridinium compounds or other cationic compounds, cationic dyes such as phenosafran, neutral salts such as thalium nitrate, potassium nitrate as described in U.S. Pat. No. 2,648,604, Japanese Patent Examined Publication No. 9503/1969, and U.S. Pat. No. 3,671,247; nonionic compounds such as polyethylene glycol and the derivatives thereof, polythioethers as described in Japanese Patent Examined Publication No. 9504/1969, U.S. Pat. Nos. 2,533,990, 2,531,832, 2,950,970, and 2,577,127; those organic solvents and organic amines such as ethanolamine, ethylenediamine, diethanolamine, and the like as described in Japanese Patent Examined Publication No. 9509/1969, and Belgian Pat. No. 682,862.

Besides, those development accelerators detailed in the "Photographic Processing Chemistry" by L. F. A. Mason, p.p. 40–43 (Focal Press—London, 1966) may also be used.

In addition, benzyl alcohol and phenethyl alcohol as described in U.S. Pat. No. 2,304,925; and pyridine, ammonia, hydrazine, amines, and the like as described in the Journal of the Society of Photographic Science and Technology of Japan, vol.14, p.74 (1952) also may, according to purposes, be effective development accelerators.

Further, sodium sulfite, potassium sulfite, potassium hydrogensulfite, and sodium hydrogensulfite may be added as well.

Furthermore, polyphosphoric acid compounds typified by sodium hexametaphosphate, sodium tetrapolyphosphate, sodium tripolyphosphate, or potassium salts of these poly phosphoric acids; and aminopolycarboxylic acids typified by ethylenediaminetetraacetic acid, nitrotriacetic acid, cyclohexanediaminetetraacetic acid, iminodiacetic acid, N-hydroxymethyl-ethylenediaminetriacetic acid, diethylenetriaminepentaacetic acid, and the like may be used as water softeners, the adding amount of each of which depends upon the hardness of water to be used, but may be normally within the range of from 0.5 to 10 g per liter. Other equivalent calcium-magnesium hiding agents may also be employed. These are described in detail in the "Belgisches Chesisches Industry" by J. Willass,vol. 21, p.325 (1956) and vol. 23, p.1105 (1958).

Organic solvents may at need be incorporated, which include ethylene glycol, hexylene glycol, diethylene glycol, methyl cellosolve, methanol, ethanol, acetone, triethylene glycol, dimethyl formamide, dimethyl sulfoxide, and those compounds as described in Japanese Patent Examined Publication Nos. 33378/1972 and 9505/1969.

The adding amount of these solvents may be varied according to the composition of the alkaline processing liquid to be used, but is normally not more than 50%, and preferably no more than 10%.

As an auxiliary developing agent, there may be used N-methyl-p-aminophenol hemisulfate (the so-called Metol), benzyl p-aminophenol hydrochloride, N,N-diethyl-p-aminophenol hydrochloride, p-aminophenol sulfate, phenydone, N,N,N',N-tetramethyl-p-phenylenediamine hydrochloride or the like, the adding amount of each of which is desirable to be normally from 0.01 to 1.0 g/liter.

In addition, to the alkaline processing liquid there may at need be added the following: for example, competing couplers (colorless couplers) such as citrazinic acid, J acid, H acid as described in Japanese Patent Examined Publication Nos. 9505/1969, 9506/1969, 9507/1969, 14036/1970, and 9508/1969, and U.S. Pat. Nos. 2,742,832, 3,520,690, 3,560,212, 3,645,737, and the like.

As fogging agents such as alkali metal borohydride, aminoboraneethylenediamine, those described in Japanese Patent Examined Publication No. 38816/1972 may be used.

The color photographic light-sensitive material of the present invention may be applied to any of such color photographic light-sensitive materials for general use as color negative film, color photographic paper, color positive film, color reversal film, and the like, and the direct positive type color photographic light-sensitive material.

Further, it may, together with a black dye forming coupler, be applied to black-and-white silver halide photographic materials, which enables to economize the use of silver halides.

The photographic light-sensitive material of the present invention is allowed to be such a small-silver-content color photographic light-sensitive material as described in U.S. Pat. Nos. 3,765,891 and 4,094,682, in which case the light-sensitive material is to be processed in a reinforcing bath containing of tervalent cobalt complex salt or hydrogen peroxide.

The color photographic light-sensitive material of the present invention has preferably such a structure that the silver halide emulsion layer contains a nondiffusible coupler that does not diffuse into different layers during the manufacture of the light-sensitive material or during the processing thereof.

As yellow couplers, generally, open-chained diketomethylene compounds are widely used, examples of which are described in, e.g., U.S. Pat. Nos. 3,341,331, 2,875,057, and 3,551,155, West German OLS Patent No. 1,547,868, U.S. Pat. Nos. 3,265,506, 3,582,322, and 3,725,072, West German OLS Patent No. 2,162,899, U.S. Pat. Nos. 3,369,895 and 3,408,194, West German OLS Patent Nos. 2,057,941, 2,213,461, 2,219,917, 3,261,361, 2,263,875, and the like.

As magenta couplers, 5-pyrazolone compounds are chiefly used, but indazolone compounds and cyanoacetyl compounds may also be used, examples of which are described in, e.g., U.S. Pat. Nos. 2,439,098, 2,600,788, 3,062,653, and 3,558,319, British Pat. No. 956,261, U.S. Pat. Nos. 3,582,322, 3,615,506, 3,519,429, 3,311,476, and 3,419,391, West German Pat. No. 1,810,464, Japanese Patent Examined Publication No. 2016/1969, and U.S. Pat. No. 2,983,608, and the like.

As cyan couplers, phenol or naphthol derivatives are chiefly used, examples of which are described in, e.g., U.S. Pat. Nos. 2,369,929, 2,474,293, 2,698,794, 2,859,826, 3,311,476, 3,458,315, 3,560,212, 3,582,322, 3,591,383, 3,386,301, 2,434,272, 2,706,684, 3,034,892, and 3,583,971, West German OLS Patent No. 2,163,811, and Japanese Patent Examined Publication No. 28836/1970.

In addition, at the time of color development reaction, the development inhibiting compound releasing type coupler (the so-called DIR coupler) or development inhibiting compound releasable compound may be added, examples of which are described in, e.g., U.S. Pat. Nos. 3,148,062, 3,227,554, 3,253,924, 3,617,291, 3,622,328, and 3,705,201, British Pat. No. 1,201,110, and U.S. Pat. No. 3,297,445, 3,379,529, 3,639,417, and the like.

In order to satisfy the characteristics required for the color photographic light-sensitive material, the above-mentioned couplers or the like may either be used in combination of not less than two kinds thereof in a same layer or of course be used by incorporating any single compound of them in two or more different layers.

The coupler is generally desirable to be added in the quantity of from 10 to 300 g per mole of silver halide, but may be varied variously according to purposes.

The coupler is desirable to be of a water-insoluble mixture with a coupler solvent (preferably an appropriately polar solvent for the color former). Those useful, typical solvents for this purpose include tri-o-cresyl phosphate, dibutyl phthalate, diethyl laurylamide, 2,4-diallyl phenol, those liquid dye stabiliers as described in the name of "the improved type photographic dye image-stabilizing solvent" in the Product Licensing Index, vol. 83, p.p.26–29 (March 1971), and the like.

The maximum spectral absorption band of the formed cyan dye is preferably from about 600 to about 680 nm, that of the formed magenta dye is preferably from about 500 to about 580 nm, and that of the formed yellow dye is preferably from about 400 to about 480 nm.

The photographic light-sensitive material of the present invention is allowed to contain one of those black dye-forming couplers as described in German (DT-OS) Pat. No. 2,644,194.

The silver halide for use in the photographic light-sensitive material of the present invention may be one that is to be prepared in the ordinary manner and be of any such a composition as of silver chloride, silver bromide, silver chlorobromide, silver iodobromide, silver chloroiodobromide, or the like. These silver halide emulsions may be chemically sensitized in normal manners. And into these emulsions such normally applicable additives as spectrally sensitizing dyes, antifoggants, hardeners, plasticizers, surfactants and the like may be incorporated.

For the support to be used for the layers of the photographic light-sensitive material of the present invention, in addition to cellulose film, plastic film, or the like, there may be effectively used glass, paper, multilayered or polymer-laminated paper or the like.

Into the light-sensitive layer of the photographic light-sensitive material an antifoggant for the silver halide may be incorporated, useful, typical examples of which include heterocyclic organic compounds such as tetrazole, azaindenes, triazoles, and mercapto group-having aromatic or heterocyclic compounds, and the like.

The layer of the photographic light-sensitive material of the present invention is permitted to contain a hardener, plasticizer, lubricant, surface-matting agent, surface-glossing agent, and other additives commonly used in the photographic field.

Those applicable hydrophilic colloids include, for example, gelatin, colloidal albumin, casein, cellulose derivatives such as carboxymethyl cellulose, hydroxyethyl cellulose, and the like; sugar derivatives such as agar-agar, sodium alginate, starch derivatives, and the like; synthetic hydrophilic colloids such as, e.g., polyvinyl alcohole, poly-N-vinyl-pyrolidone, polyacrylic acid copolymers, polyacrylamide or derivatives thereof, partially hydrolyzed products thereof, and the like. These colloids may, if necessary, be used in the form of a compatible mixture of not less than two kinds thereof. Among them the most generally used is gelatin. Gelatin may be not only partially or wholly replaced by synthetic macromolecular materials but replaced by the so-called gelatin derivatives; i.e., those obtained by modifying in the manner in which the amino, imino, hydroxyl and carboxyl groups as the functional groups contained in the molecules of gelatin are treated with a reagent having one group reactable therewith, or those craft polymers obtained by combining the molecules of gelatin with the molecules of other macromolecular materials.

The photographic emulsion may be subjected to spectral sensitization or hyper-color sensitization by the single or combined use of cyanine dyes such as cyanine, merocyanine, hemicyanine dyes, etc., or the combined use of stilyl dyes therewith, and the techniques of sensitization by the use of these dyes have been known for long and described in, e.g., U.S. Pat. Nos. 2,493,748, 2,519,001, 2,977,229, 3,480,434, 3,672,897, 3,703,377, 2,688,545, 2,912,329, 3,397,060, 3,615,635, and 3,628,964, British Pat. Nos. 1,195,302, 1,242,588, and 1,293,862, West German OLS Patent Nos. 2,030,326 and 2,121,780, Japanese Patent Examined Publication Nos. 4936/1968, 14030/1969, and 10773/1968, U.S. Pat. Nos. 3,511,664, 3,522,052, 3,527,641, 3,615,613, 3,615,632, 3,617,295, 3,635,721, and 3,694,217, and British Pat. Nos. 1,137,580 and 1,216,203, and the like. The selection of sensitizers to be used may be arbitrarily determined according to the purpose of the light-sensitive material such as the wavelength region to which the photographic material is desired to be sensitized, the photographic speed, and the like.

The photographic emulsion is coated on such a support as a flat sheet material that is subjected to no remarkable dimentional change during the processing thereof; for example, such a hard support as glass, metal, earthenware, or the like, or a flexible support typical examples of which include those used normally for photographic light-sensitive materials, such as cellulose nitrate film, cellulose acetate film, cellulose acetate-butyrate film, cellulose acetate-propionate film, polystyrene film, polyethylene terephthalate film, polycarbonate film, and stratified material of these films, thin glass film, paper, and the like. Baryta paper or paper coated or laminated with an α-olefin polymer having from 2 to 10 carbon atoms, such as polyethylene, polypropylene, ethylene-butene copolymer or the like, or such a plastic film as is improved in the printability as well as in the contact with other macro-molecular materials by matting the surface thereof as described in Japanese Patent Examined Publication No. 19068/72 may also be satisfactorily used as the support.

From these support materials any suitable transparent or opaque one may be selected according to the purpose of the light-sensitive material used. In the case of being transparent, it can be made not only colorless transparent but colored transparent by the addition of a dye or pigment. This has been performed conventionally in X-ray films and the like and known as is described in J. SMPTE, vol. 67, p.296 (1958), and the like.

Opaque support materials include, in addition to those essentially opaque as paper, those prepared by adding dyes or pigments to transparent film, plastic film surface-treated in such a manner as described in Japanese Patent Examined Publication No.19068/1972, and further, paper or plastic film made totally light-tight by adding carbon black or dyes. If the adherence of the support to the emulsion layer is insufficient, a layer that is capable of adhereing to both is provided as a subbing layer on the support. And in order to better the adherence capability, the surface of the support may be subjected to such preliminary treatments as corona discharge, ultraviolet irradiation, flame treatment, and the like.

As has been mentioned, the photographic light-sensitive material of the present invention comprises a support and dye image supply unit layers provided thereon. The multicolor image-giving multilayer color photographic light-sensitive material has at least two of the foregoing dye image supply unit layers, and the layers first record selectively spectral light in their different areas, respectively. The unit layers each contains a light-sensitive silver salt that, in general, is selectively spectrally sensitive to spectral light in a specific area thereof, the silver salt being normally in combination with a photographic coupler. In order to prevent any color stain between the dye image unit layers, a barrier layer, a spacing layer, a layer containing an agent for removing the oxidized product of a developing agent, or other layers are provided therebetween to efficiently separate the said two layers. The efficient separation of such unit layers is in the prior art in the photographic field, and is extensively utilized in many commercial color light-sensitive materials. And a light-sensitive material having such a layer for preventing the occurrence of development stain as described in U.S. Pat. No. 3,737,317 may also be applied to the present invention.

The compounds to be used in the present invention may be used either singly or in combination of not less than two kinds thereof.

It is obvious that the use of the color photographic light-sensitive material of the present invention enables to obtain a sufficiently high color image density as compared to the conventional type light-sensitive material into which is incorporated an aromatic primary amine developing agent and/or the precursor thereof. Further, the photographic light-sensitive material of the present invention, even though the coating amount of the aromatic primary amine developing agent and/or the precursor thereof is reduced, enables to obtain a sufficiently high color image density, and in addition, enables to prevent significantly the deterioration of the photographic speed thereof and the occurrence of fog and stain during the storage of the light-sensitive material.

The present invention is subsequently illustrated in further detail with reference to examples below, but the embodiment of the present invention is not limited thereto.

EXAMPLE 1

The following layers were coated in order on a resin-coated paper support to thereby prepare samples 1 to 7:

Preparation of sample 1:

Layer 1 . . . Yellow dye forming blue-sensitive silver halide emulsion layer:

Coupler α-(1-benzyl-2,4-dioxo-3-imidazolidinyl)-α-pivalyl-2-chloro-5-[γ(2,4-di-t-amylphenoxy)-butylamide]acetanilide was dissolved into dibutyl phthalate (hereinafter referred to as DBP), and the mixture was dispersed into an aqueous gelatin solution. The dispersed liquid was then added to a silver chloroiodobromide emulsion containing 1 mole % silver iodide and 80 mole % silver bromide, and the resulting emulsion was coated so that the coating amounts of silver and of the coupler are 420 mg/m$^2$ and 562 mg/m$^2$, respectively.

Layer 2 . . . Interlayer (gelatin layer having the thickness of 1μ)

Layer 3 . . . Green-sensitive silver halide emulsion layer:

Magenta coupler 1-(2,4,6-trichlorophenyl)-3-(2-chloro-5-octadecylsuccinimicoanilino)-5-pyrazolone was dissolved into tricresyl phosphate (hereinafter referred to as TCP), and the mixture was dispersed into an aqueous gelatin solution. The dispersed liquid was then added to a silver chlorobromide emulsion containing 30 mole % silver bromide, and the resulting emulsion was coated so that the coating amounts of silver and the coupler are 580 mg/m$^2$ and 684 mg/m$^2$, respectively.

Layer 4 . . . Aromatic primary amine developing agent precursor layer:

Exemplified compound B-13 aromatic primary amine developing agent precursor was dissolved into dioctyl phthalate, and the mixture was dispersed into an aqueous gelatin solution. The dispersed liquid was then coated so that the coating amount of the aromatic primary amine developing agent precursor is 250 mg/m$^2$.

Layer 5 . . . Cyan dye forming red-sensitive silver halide emulsion layer:

Cyan coupler 2,4-dichloro-3-methyl-6-[α(2,4-di-t-amylphenoxy)butylamide]phenol was dissolved into TCP, and the mixture was dispersed into an aqueous gelatin solution. The dispersed liquid was then added to a silver chlorobromide emulsion containing 80 mole % silver bromide, and the resulting emulsion was coated so that the coating amounts of silver and of the coupler are 520 mg/m$^2$ and 458 mg/m$^2$, respectively.

Layer 6 Aromatic primary amine developing agent precursor layer (the same as Layer 4)

Layers 1, 3 and 5 each contains 4-hydroxy-6-methyl-1,3,3a,7-tetrazaindene sodium salt as a stabilizer, bis(vinyl-sulfonyl-methyl)ether as a hardener, and saponin as a coating aid.

Preparation of samples 2 to 7

On sample 1 was provided each of the polymer layers of the present invention to thereby prepare samples 2 to 7. The polymer layers were prepared in the manner that aqueous dispersion liquids containing the polymers given in Table 1, respectively, were precipitated by the addition of methanol and then dried, which were subsequently dissolved into ethyl acetate. The thus obtained solutions were coated on sample 1, respectively. The coating amount of each of the polymers was 100 mg/m$^2$.

TABLE 1

| Sample No. | Polymer |
|---|---|
| 2 | Exemplified compound A-1 |
| 3 | Exemplified compound A-5 |
| 4 | Exemplified compound A-18 |
| 5 | Exemplified compound A-24 |
| 6 | Exemplified compound A-26 |
| 7 | Exemplified compound A-31 |

The thus obtained samples 1 to 7 each was exposed through an optical step wedge to a white light, and then processed in the following processing steps.

| Processing steps | Temperature | Processing period |
|---|---|---|
| Alkaline processing | 30° C. | 3 minutes |
| Bleach-fixing | 30° C. | 1 minute |
| Washing | 30° C. | 2 minutes |
| Stabilizing | 30° C. | 1 minute |
| Washing | 30° C. | 10 minutes |
| Drying | (Not more than 95° C.) | |

The compositions of the respective processing liquids are as follows:

| | |
|---|---|
| **Alkaline processing liquid:** | |
| Benzyl alcohol | 14 ml |
| Sodium sulfite | 2 g |
| Potassium bromide | 0.5 g |
| Sodium carbonate, monohydrated | 30 g |
| Water to make 1 liter | |
| **Bleach-fixing liquid:** | |
| Ammonium thiosulfate (70%) | 150 ml |
| Sodium sulfite | 5 g |
| Na[Fe(III) (EDTA)] | 40 g |
| EDTA | 4 g |
| Water to make 1 liter | |
| (EDTA stands for Ethylenediamine-tetraacetic acid) | |
| **Stabilizing liquid:** | |
| Glacial acetic acid | 10 ml |
| Sodium acetate | 5 g |
| Formalin (37%) | 5 ml |
| Water to make 1 liter | |

The fog values of the yellow (Y), magenta (M) and cyan (C), relative speeds, and maximum developed color densities of the thus processed samples are as shown in Table 2. In addition, the relative speeds are the values obtained when the Y, M and C of sample 1 are regarded as 100, respectively.

TABLE 2

| Sample No. | Polymer Exemplified compound | Fog | | | Relative speed | | | Maximum color density | | |
|---|---|---|---|---|---|---|---|---|---|---|
| | | Y | M | C | Y | M | C | Y | M | C |
| 1 (Control) | No polymer | 0.06 | 0.07 | 0.06 | 100 | 100 | 100 | 1.46 | 1.85 | 1.73 |

TABLE 2-continued

| Sample No. | Polymer Exemplified compound | Fog | | | Relative speed | | | Maximum color density | | |
|---|---|---|---|---|---|---|---|---|---|---|
| | | Y | M | C | Y | M | C | Y | M | C |
| 2 (Invention) | A-1 | 0.07 | 0.07 | 0.07 | 121 | 118 | 128 | 1.85 | 2.21 | 2.15 |
| 3 (Invention) | A-5 | 0.08 | 0.09 | 0.08 | 116 | 111 | 121 | 1.78 | 2.15 | 2.07 |
| 4 (Invention) | A-18 | 0.06 | 0.07 | 0.07 | 125 | 121 | 130 | 1.97 | 2.36 | 2.25 |
| 5 (Invention) | A-24 | 0.08 | 0.08 | 0.07 | 120 | 115 | 127 | 1.83 | 2.30 | 2.17 |
| 6 (Invention) | A-26 | 0.07 | 0.08 | 0.06 | 109 | 105 | 117 | 1.65 | 2.08 | 2.05 |
| 7 (Invention) | A-31 | 0.08 | 0.09 | 0.08 | 123 | 118 | 129 | 1.93 | 2.35 | 2.27 |

As apparent from Table 2, the samples (samples 2 to 7) of the present invention, as compared to the control sample (sample 1), have high maximum densities and increased speeds, and yet they are on the same level in fog as the control sample, thus showing excellent photographic characteristics.

EXAMPLE 2

In place of the compound B-13 added to layers 4 and 6 of sample 1 in Example 1, compound B-25 was added to layers 4 and 6 to be coated so that the coating amount is 250 mg/m$^2$, respectively, thereby preparing sample 8. Further, compound B-25 was added to layers 4 and 6 to be coated so that the coating amount is 125 mg/m$^2$, respectively, thereby preparing sample 9. On both samples 8 and 9 were provided the polymer layers of the present invention, respectively, in the same manner as in Example 1, thereby preparing samples 10 to 13. The kinds and amounts of the aromatic primary amine developing agent precursor which were added to and the compounds used in the polymer layers which were provided on the top of samples 8 to 13 are as given in Table 3.

TABLE 3

| Sample No. | Aromatic primary amine developing agent precursor | Adding amount of aromatic primary amine developing agent precursor (mg/m$^2$) layer 4 | layer 6 | Polymer compound |
|---|---|---|---|---|
| 8 | Compound B-25 | 250 | 250 | No polymer layer |
| 9 | Compound B-25 | 125 | 125 | No polymer layer |
| 10 | Compound B-25 | 250 | 250 | Exemplified compound A-18 |
| 11 | Compound B-25 | 125 | 125 | Exemplified compound A-18 |
| 12 | Compound B-25 | 250 | 250 | Exemplified compound A-24 |
| 13 | Compound B-25 | 125 | 125 | Exemplified compound A-24 |

The thus obtained samples 8 to 13 were exposed and processed in the same manner as in Example 1. In addition to this, samples 8 to 13 were subjected to aging tests by allowing them to stand in the air under the condition of a temperature of 50° C. for a period of two days, and after that the respective samples were exposed and processed under the same conditions as the above. The fog values of the yellow (Y), magenta (M) and cyan (C), relative speeds, and maximum eveloped color densities of thus processed samples are as shown in Table 4. The relative speeds in the table are the values obtained when the speeds of the Y, M and C of sample 8 (not subjected to the aging test) are regarded as 100.

TABLE 4

| Sample No. | Fog | | | Relative speed | | | Max. color density | | |
|---|---|---|---|---|---|---|---|---|---|
| | Y | M | C | Y | M | C | Y | M | C |
| 8 (Control) | 0.06 | 0.05 | 0.05 | 100 | 100 | 100 | 2.26 | 2.28 | 2.22 |
| 9 (Control) | 0.05 | 0.04 | 0.04 | 73 | 70 | 62 | 1.53 | 1.61 | 1.48 |
| 10 (Invention) | 0.07 | 0.07 | 0.06 | 103 | 104 | 103 | 2.41 | 2.46 | 2.42 |
| 11 (Invention) | 0.06 | 0.05 | 0.05 | 100 | 101 | 102 | 2.28 | 2.31 | 2.25 |
| 12 (Invention) | 0.08 | 0.07 | 0.07 | 105 | 106 | 103 | 2.43 | 2.48 | 2.43 |
| 13 (Invention) | 0.06 | 0.06 | 0.06 | 102 | 101 | 103 | 2.31 | 2.32 | 2.28 |
| AFTER AGING | | | | | | | | | |
| 8 (Control) | 0.15 | 0.12 | 0.10 | 81 | 79 | 76 | 2.13 | 2.11 | 2.12 |
| 9 (Control) | 0.08 | 0.08 | 0.07 | 70 | 65 | 56 | 1.41 | 1.48 | 1.40 |
| 10 (Invention) | 0.09 | 0.08 | 0.08 | 96 | 96 | 98 | 2.37 | 2.40 | 2.37 |
| 11 (Invention) | 0.08 | 0.07 | 0.07 | 95 | 94 | 96 | 2.24 | 2.25 | 2.18 |
| 12 (Invention) | 0.10 | 0.09 | 0.08 | 97 | 98 | 96 | 2.36 | 2.43 | 2.39 |
| 13 (Invention) | 0.08 | 0.07 | 0.07 | 95 | 94 | 95 | 2.26 | 2.25 | 2.21 |

As seen from Table 4, the samples of the present invention, although the aromatic primary amine developing agent precursor was incorporated therein in the quantity reduced by half, enabled to give sufficiently high maximum color densities with little increase in fog; that is, samples 11 and 13 of the present invention, as shown in Table 3, although the coated amount of the aromatic primary amine developing agent precursor thereof is half that of the same agent of sample 8 (control), enabled to obtain maximum color densities equivalent to that of sample 8 (control). And as compared to samples 10 and 12, they have very little deterioration of maximum color densities by reducing the coating amount by half, whereas sample 9 (control) shows considerable deterioration of the maximum color density by reducing the amount of the aromatic primary amine developing agent precursor thereof by half.

It is understood from the results of the aging test given in Table 4 that fog increases largely with the increase in the amount of the aromatic primary amine developing agent precursor, so that the amount is desirable to be small to a certain extent. This fact also proves that the effect of the present invention is excellent.

EXAMPLE 3

In order to examine the amount of the aromatic primary amine developing agent precursor that has run out of the light-sensitive material during the development thereof into and has been accumulated in the alkaline processing liquid, a test piece of 1 $m^2$ in size was taken from each of sample 9 (control) and sample 13 that were prepared in Example 2 and was exposed and then processed for three minutes at 30° C. in one liter of the alkaline processing liquid of the same composition as was used in Examples 1 and 2, and after that the aromatic primary amine developing agent precursor content of the alkaline processing liquid was measured. The measurement was made by the use of a spectrophotometer to obtain the absorption strength of the spectral absorption by the aromatic primary amine developing agent precursor, from which the amount of the aromatic primary amine developing agent precursor contained in the processing liquid was determined.

As the result of the measurement, the amounts of the aromatic primary amine developing agent precursor contained in the one-liter alkaline processing liquids after the processings of sample 9 (control) and sample 13 (the invention) were 87 mg and 36 mg, respectively. From the results, it is obvious that the present invention is capable of reducing the amount of the aromatic primary amine developing agent precursor to run into the alkaline processing liquid, so that, in the case of processing in succession in an automatic processor, there is the advantage that even a smaller quantity of a processing liquid replenisher is enough to perform stably the successive processing.

What is claimed is:

1. A color photographic light-sensitive material comprising a support and a hydrophilic colloid layer coated thereon, said layer comprising a non-diffusible coupler and a hydrophilic colloid layer having an aromatic primary amine developing agent and/or a precursor thereof, said material further comprising a polymer layer at the furthest position from the support on the same side of said support as said hydrophilic colloid layer wherein said polymer layer is permeable to an alkaline processing liquid but less permeable to said aromatic primary amine developing agent and/or a precursor thereof and said developing agent or precursor thereof has a diffusion rate, while dissolved in said alkaline processing liquid, in said polymer layer which is not greater than $5\times10^{-8}$ $cm^2$/second at room temperature.

2. A color photographic light-sensitive material comprising a support and a hydrophilic colloid layer coated thereon, said layer comprising a non-diffusible coupler and a hydrophilic colloid layer having an aromatic primary amine developing agent and/or a precursor thereof, said material further comprising a polymer layer at the furthest position from the support on the same side of said support as said hydrophilic colloid layer wherein said polymer layer is permeable to an alkaline processing liquid but less permeable to said aromatic primary amine developing agent and/or a precursor thereof and said developing agent or precursor thereof has a diffusion rate, while dissolved in said alkaline processing liquid, in said polymer layer which is not greater than $5\times10^{-8}$ $cm^2$/second at room temperature, and wherein said polymer layer consists of a copolymer of Formula I $$-(A)_x(B)_y(C)_z \quad \text{Formula (I)}$$

wherein A is a unit of a vinylidene chloride monomer or a copolymerizable conjugated diene monomer; B is a unit of a copolymerizable ethylenically unsaturated acid monomer or the salt thereof; C is a unit of a copolymerizable ethylenically unsaturated monomer; x is from 50 to 99.5% by weight; y is from 0.5 to 10% by weight; and z is from 0 to 49.5% by weight.

3. A color photographic light-sensitive material according to claim 1, wherein said non-diffusible coupler is a yellow coupler, a magenta coupler or a cyan coupler.

4. A color photographic light-sensitive material according to claim 3, wherein said yellow coupler is open-chained diketomethylene compound.

5. A color photographic light-sensitive material according to claim 3, wherein said magenta coupler is 5-pyrazolone compound.

6. A color photographic light-sensitive material according to claim 3, wherein said cyan coupler is a phenol or naphtol derivative.

7. A color photographic light-sensitive material according to claim 2, wherein the copolymerizable conjugated diene monomer unit represented by A is 1,3-butadiene, alkyl-substituted-1,3-butadiene, aryl-substituted-1,3-butadiene, halogen-substituted-1,3-butadiene, cyano-substituted-1,3-butadiene.

8. A color photographic light-sensitive material according to claim 2, wherein B is one selected from the group consisting of acrylic acid, methacrylic acid, itaconic acid, itaconic acid monoalkyl ester, maleic acid monoester and alkali metallic salts of these acid.

9. A color photographic light-sensitive material according to claim 2, wherein C is one selected from the group consisting of ethylenically unsaturated nitrils, styrenes, acrylic acid esters, methacrylic acid esters, acrylamides, methacrylamides, vinyl heterocyclic compounds and a cross linkable monomer.

10. A color photographic light-sensitive material according to claim 2, wherein the copolymerizable conjugated diene monomer unit represented by A is 1,3-butadiene, isoprene or 2,3-dimethyl-1,3-butadiene.

11. A color photographic light-sensitive material according to claim 2, wherein B is acrylic acid, methacrylic acid, itaconic acid or monomethyl ester.

12. A color photographic light-sensitive material according to claim 2, wherein C is one selected from the group consisting of ethylenically unsaturated nitriles, acrylic acid esters, methacrylic acid esters.

13. A color photographic light-sensitive material according to claim 2, wherein x is from 50 to 80.

14. A color photographic light-sensitive material according to claim 2, wherein y is from 0.5 to 8.

15. A color photographic light-sensitive material according to claim 2, wherein z is from 15 to 45.

16. A color photographic light-sensitive material according to claim 2, wherein said nondiffusible coupler is a yellow coupler, a magenta coupler or a cyan coupler.

17. A color photographic light-sensitive material according to claim 16, wherein said yellow coupler is open-chained diketomethylene compound.

18. A color photographic light-sensitive material according to claim 16, wherein said magenta coupler is 5-pyrazolone compound.

19. A color photographic light-sensitive material according to claim 16, wherein said cyan coupler is a phenol or naphtol derivative.

20. A color photographic light-sensitive material according to claim 1, wherein said aromatic primary amine developing agent is represented by the formula:

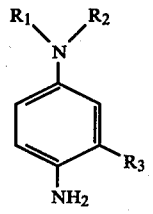

wherein $R_1$, $R_2$ and $R_3$ is independently a hydrogen atom or a substituted or unsubstituted alkyl group having from 1 to 4 carbon atoms.

21. A color photographic light-sensitive material according to claim 1, wherein said precursor of said aromatic primary amine developing agent is one selected from the group consisting of a schiff base of aromatic primary amine developing agent with salicylaldehyde, a addition products of aromatic primary amine with metal, phthal imide type one obtained by the reactiion between an aromatic primary amine and a phthalic acid, one obtained by the combination of aromatic primary amine with β-(benzenesulfonyl)-ethoxy carbony, one obtained by the combination of aromatic primary amine with β-cyanoethoxy carbonyl and one obtained by the addition of tetraphenyl boron to aromatic primary amine.

22. A color photographic light-sensitive material according to claim 1, wherein said hydrophilic colloidal layer comprising a nondiffusible coupler and said hydrophilic colloidal layer comprising an aromatic primary amine developing agent and/or a precursor thereof are the same layer.

* * * * *